United States Patent [19]

Courrege

[11] Patent Number: 4,886,446

[45] Date of Patent: Dec. 12, 1989

[54] GAS BURNER OF THE COLD NOZZLE TYPE

[75] Inventor: Claude Courrege, Le Haillan, France

[73] Assignee: Stepack, France

[21] Appl. No.: 193,476

[22] Filed: May 12, 1988

[30] Foreign Application Priority Data

May 12, 1987 [FR] France ..... 87 06930

[51] Int. Cl.[4] ..... F23D 14/14

[52] U.S. Cl. ..... 431/329; 431/346; 431/354; 239/590.3; 239/592

[58] Field of Search ..... 431/158, 329, 346, 350, 431/353, 354, 355; 126/401–406, 271.2 A; 239/504, 518, 590.3, 590.5, 592, 597

[56] References Cited

U.S. PATENT DOCUMENTS

| | | | |
|---|---|---|---|
| 554,253 | 2/1896 | Finlay | 431/346 |
| 1,354,295 | 9/1920 | Hamilton | 431/346 |
| 1,368,120 | 2/1921 | Cole | 431/346 |
| 2,985,233 | 5/1961 | Stellmach | 431/355 |
| 3,035,632 | 5/1962 | Ericsson | 431/346 |
| 3,288,377 | 11/1966 | Van de Roer | 239/592 X |
| 3,617,161 | 11/1971 | Polidero | 431/350 X |
| 3,852,025 | 12/1974 | Placek | 431/329 |
| 4,631,023 | 12/1986 | Courrege | 431/354 X |

*Primary Examiner*—Margaret A. Focarino
*Attorney, Agent, or Firm*—William A. Drucker

[57] ABSTRACT

A gas burner of cold nozzle type is provided including an injection device for injecting a flow of a fuel gas mixture into a burner head, including successively: a pressure recovery chamber having a divergent profile, an ignition chamber having two parallel walls extended by two deflectors whose front edges form therebetween a passage of reduced width, and a diffusion grid forming a convex wall between said chambers. The front edges of the deflectors and said diffusion grid have substantially coaxial circular shapes.

8 Claims, 3 Drawing Sheets

GAS BURNER OF THE COLD NOZZLE TYPE

BACKGROUND OF THE INVENTION

1. Field of the invention

The present invention relates to a gas burner,of the cold nozzle type, for causing high speed external combustion of a gas mixture.

It applies more particularly but not exclusively to the low temperature heating of plastic material films, for example polyethylene films to cause retraction thereof, by means of a gas flow coming from the combustion of a combustible gas such as propane and air.

To comply with this type of application, the burner must be designed so as to produce a gas flow having a temperature of the order of 120° to 540° C. at a predetermined distance from the burner (distance at which the plastic film to be treated must be disposed).

At this distance, the temperature must be relatively homogeneous and the gas flow free of combustion material, if any possibility of burning, scorching and blistering of the film is to be avoided.

2. Description of the Prior Art

In order to reach this result, a burner has already been proposed including an injection device adapted for producing a high speed flow of a fuel gas mixture and injecting this flow into a tubular shaped burner head comprising successively:

a pressure recovery chamber having, in the plane of symmetry of the head, a divergent shape and inside which the gas mixture coming from the injection device develops in a fan configuration, an ignition chamber of substantially constant and rectangular section, two deflectors which extend respectively the two large sides of the ignition chamber and which converge towards each other, these two deflectors having two rectilinear front edges forming therebetween a passage of reduced width, and a diffusion grid of substantially semi-cylindrical shape fixed inside the head at the level of the junction of the two chambers, this grid forming a convex dividing wall, directed parallel to said edges in said plane of symmetry, and whose concavity is oriented inwardly of the pressure recovery chamber.

With the above described structure, the burner head is not licked by the flame and therefore is not subjected to appreciable overheating.

However, contrary to what was expected, the flame produced does not have a strictly rectilinear and homogeneous leading edge.

In fact, it has been found in use that the leading edge of this flame in its central region has a substantially rectilinear edge bordered laterally by two respective horn-shaped protuberances.

It is clear that the presence of these side horns means that the advantages offered in other respects by this type of burner cannot be fully used.

A first aim of the invention is therefore to overcome this drawback. Moreover, it so happens that the burners of this kind are very widely used as "hand burners" and consequently have a handle which the operator holds in his hand.

During his work, he must sweep over the film to be treated holding the burner turned so as to keep the rectilinear front edge of the flame parallel to the zone of the film undergoing treatment, in order to obtain homogenous heating of this zone.

Now, such parallelism is difficult to acquire then to maintain.

Consequently, it is difficult to avoid untimely orientations which cause temperature heterogeneities which risk deteriorating the film.

The invention also overcomes this drawback.

SUMMARY OF THE INVENTION

To attain these results, the invention proposes a burner of said type more particularly characterized in that the front edges of the two large sides of the ignition chamber, at which the deflectors are joined up, the front edges of the deflectors and the diffusion grid have substantially coaxial circular shapes.

Tests made on this burner show that a flame is obtained whose leading edge has a circular shape free of horns.

Furthermore, by choosing an appropriate radius of curvature for said edges and the grid, it is possible to arrange things so that a variation of orientation of the burner does not cause modification of the heating provided in the zone of the film being treated.

BRIEF DESCRIPTION OF THE DRAWINGS

One embodiment of the invention wil be described hereafter by way of non limitative example, with reference to the accompanying drawings in which.

DESCRIPTION OF THE PREFERRED EMBODIMENT

As mentioned above, the burner in accordance with the invention includes an injection device 1 for transmitting to the head of burner 2 a fuel gas mixture flow.

Figure 1:
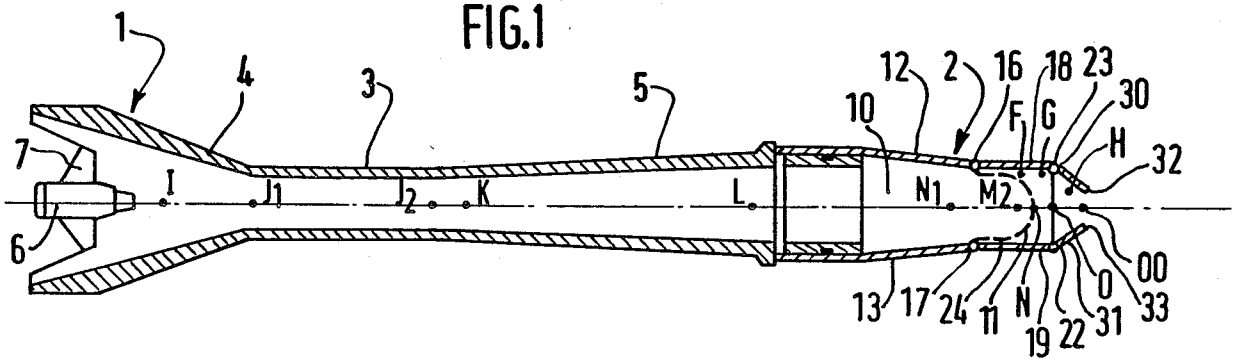
FIG. 1 is a schematical axial section showing the structure of a burner in accordance with the invention.

Thus, in the example shown in FIG. 1, the injection device 1 comprises more particularly:

a pipe 3 formed in two sections, namely a rear convergent section 4 and a front substantially divergent section 5.

an injection nozzle 6 mounted in the convergent section 4, this nozzle 6 being connected to an inflammable gas source at a pressure of the order of 3 to 4 bars, and at least one air passage opening 7 situated in the annular zone between said nozzle 6 and said section 4.

This device forms then a jet pump which drives the air coming through opening 7 and generates in the convergent portion 4 of pipe 3 (point I) a high speed flow of a gas mixture, of the order of 12660 m/min.

Inside the divergent portion 5, this speed decreases gradually (point $J_1$ to 6000 m/min, point $J_2$ to 5000 m/min, point K to 3500 m/min) so that it reaches the input of the burner head 2 at a speed which remains however relatively high (point L substantially at 1000 m/min).

The tubular shaped burner head 2 is formed of two parts which define successively a pressure recovery chamber 10 connected to the pipe and an ignition chamber 11 vented to the atmosphere.

Figure 2:
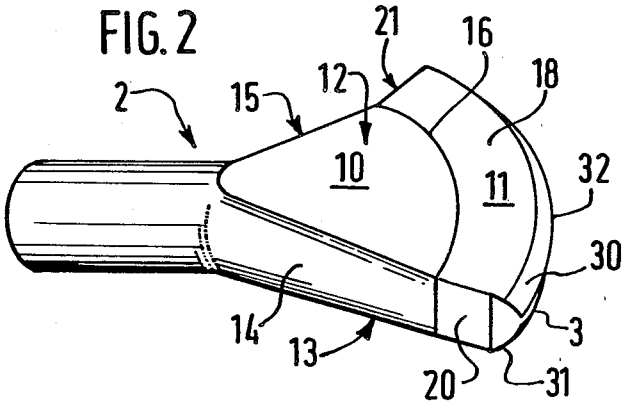
FIG. 2 is a schematical perspective view of a burner head in accordance with the invention.
Figure 3:
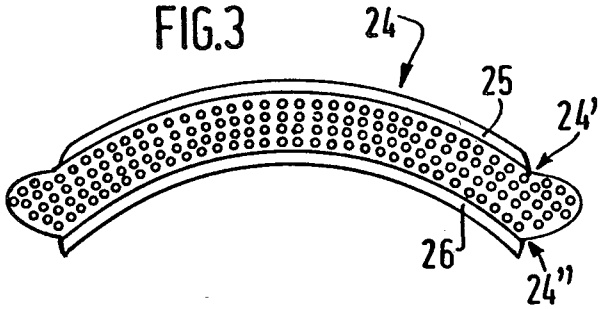
FIG. 3 is a schematical perspective view of the grid used in the burner of FIG. 1.
Figure 4:
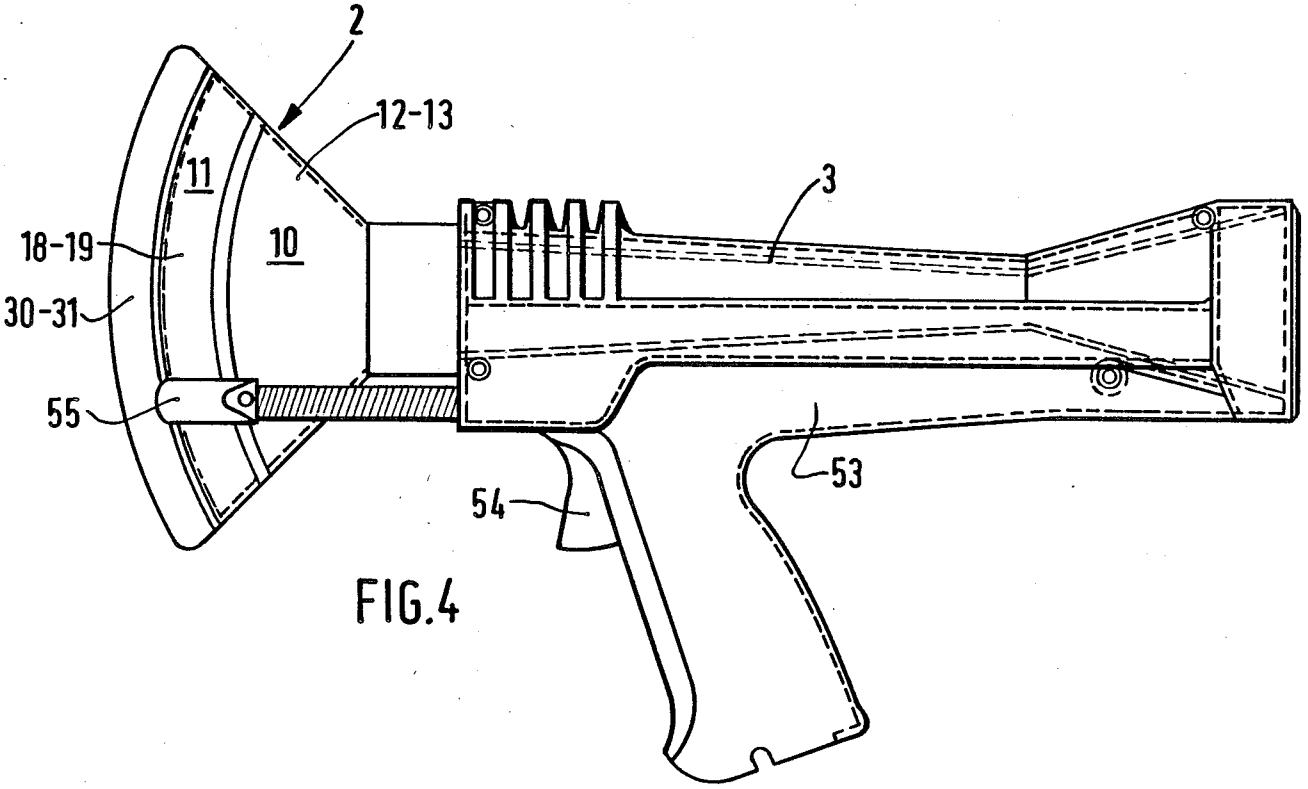
FIG. 4 is a side view of a gun type hand burner having a burner head of the type shown in FIG. 2.

The pressure recovery chamber 10 has, beyond its connection zone to pipe 3, a widened shape defined by two convergent walls 12,13 of increasing width and two divergent sidewalls 14, 15 of descreasing width. As can be seen in FIGS. 2 to 3, the front edges 16, 17 of the two convergent walls 12, 13 have coaxial circular shapes.

The ignition chamber 11 has a shape which also widens out. However, in this example, it is defined by two parallel walls 18, 19 which extend the convergent walls 12, 13 and two divergent sidewalls 20, 21 which extend the sidewalls 14, 15, respectively with the same orientations. The front edges 22, 23 of the two walls 18, 19 are circular and extend coaxially to edges 16, 17.

These two chambers 10, 11 are separated from each other by a diffusion grid 24 which consists of a perforated metal sheet in the shape of a toric sector of substantially semicylindrical section, and whose large radius of curvature corresponds substantially to that of the front edges 16, 17 of the convergent walls 12, 13. The side edges 24', 24' of this grid form flow paths with the two sidewalls 18, 19 for the gas flow in which, as will be explained further on, combustion cannot take place.

This diffusion grid 24 is fixed inside the burner head 2 in the junction zone of chambers 10 and 11, the concavity of this grid being turned towards the pressure recovery chamber 10.

For this purpose, grid 24 has two flanges 25, 26 conferring thereon a substantially omega shape, namely whose section has a curved shape bordered by two side wings.

The walls 18 and 19 of the ignition chamber 11 are extended by two cricular deflectors 30, 31 which converge substantially towards each other and have two respective coaxial edges 32, 33 forming a passage space therebetween of a width less than the width of the lateral sides 20, 21 of the ignition chamber 11.

The operating principles of this burner head is then as follows:

Inside the pressure recovery chamber 10, the speed of the gas mixture undergoes a slight reduction while developing into a fan configuration. At the level of the diffusion grid 24, a relatively homogeneous pressure zone is then formed due to conversion of the kinetic energy of the gas flows.

Through the perforations of grid 24, the fuel mixture forms a succession of jets again accelerated (point N to 2400 m/min).

In the middle part of grid 24, these jets are oriented axially whereas in the side parts, they are substantially radial and strike walls 18, 19 and deflectors 30, 31.

It can be seen that in the middle part of grid 24, the gas flow formed by the jets undergoes a deceleration $\Delta V_1$ (point 0 at 1600 m/min). This is due to the fact that on leaving the perforations of the middle zone of grid 24, an expansion of the fuel mixture occurs, such expansion being promoted by the distribution of the gas flow into jets. This reduction of the flow speed means that combustion can take place at a slight distance from grid 24.

Beyond point 0, combustion of the gas mixture takes place and a slight acceleration of the gases can be observed (expansion due to combustion). However, the speed at point 00 remains less than that measured at point N.

Furthermore, the gas flow coming from the perforations situated in the side portions of the perforated grid 24 undergoes a much higher deceleration $\Delta V_2$ than the deceleration $\Delta V_1$. In fact, the gas flow strikes walls 18, 19 of the ignition chamber 11 and is slowed down. This gas flow further crates, along walls 18, 19 and on deflectors 30, 31, two flow zones at a higher pressure with low acceleration (points F, G, H respectively at 600, 650, 800 m/min) in which the flame is not propagated (dead space). The walls 18, 19 of the ignition chamber 11 and deflectors 30, 31 which are not licked by the flame and are ventilated by the fuel mixture flow therefore do not overheat but are on the contrary constantly cooled.

This explains the reason why the burner does not undergo an appreciable temperature rise (cold nozzle burner).

As has been mentioned, on leaving the diffusion grid 24, the speed of the gas flow is not homogeneous, which should theoretically lead to heterogeneity of the flame.

This drawback is overcome through the use of deflectors 30, 31 which deflect the flow zones of the fuel mixture coming from the side portions of grid 24 and causes them to converge slightly towards the central region of the gas flow.

Concurrently, the speed of this gas flow is brought, by entrainment effect, back substantially to that of the central part of the flow. The combustion of the gas mixture then forms, beyond the front edges of deflectors 30, 31, a fan shaped flame.

Figure 6:
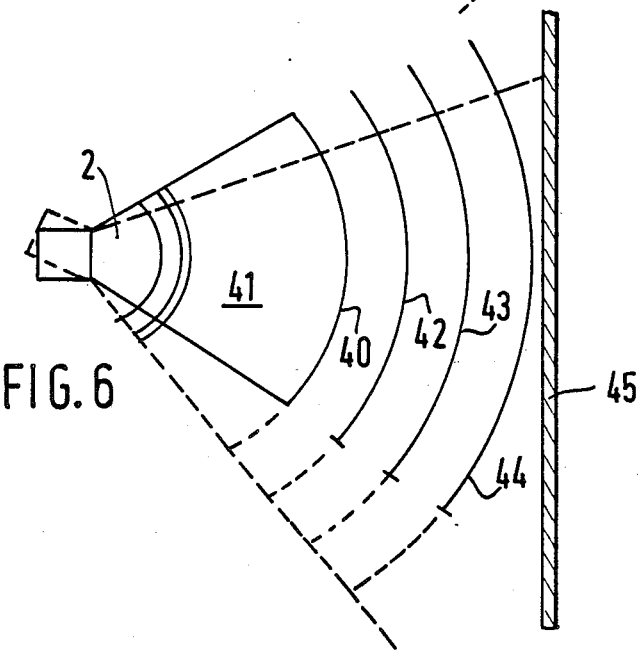
FIG. 6 is a schematical representation showing the action of the burner in accordance with the invention.

Because of the space of the burner head 2 and in particular the circular shape of the front edges 32, 33 of deflectors 30, 31 and of the diffusion grid 24, the leading edge 40 of flame 41 also has a coaxial circular shape (figure 6).

At the level of this leading edge 40, the temperature of the gas flow is substantially homogeneous and isotherm. Beyond this leading edge 40, the temperature decreases gradually, with circular isotherms 42, 43, 44 of the same type as those shown in FIG. 6.

In this FIG. 6, it will be noted that the isotherm 44 is tangent to the surface of the film to be treated 45 and that this feature is maintained even if the burner head 2 undergoes a variation of slant such as that shown with broken lines.

It is therefore clear that this slant variation does not lead to the risk of having on a given zone of the film 45, a temperature rise likely to lead to burning, scorching or even blistering.

Such would not be the case if a burner were used of a type similar to that described previously but in which the front edges of the ignition chamber and the deflectors as well as the diffusion grid are rectilinear.

Figure 5:
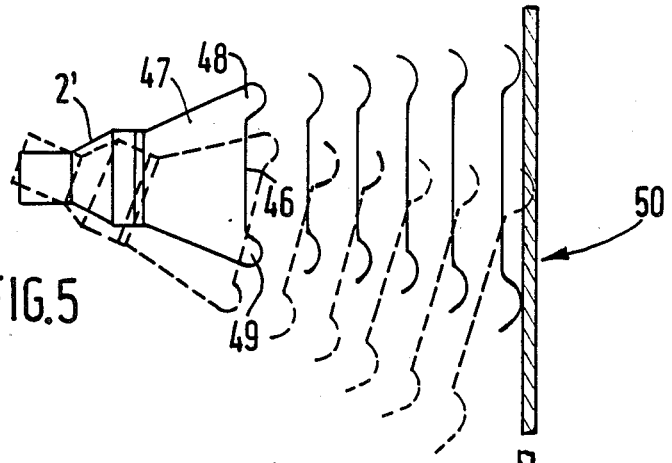
FIG. 5 is a schematical representation showing the action of a rectilinear grid burner in which the front edges of the ignition chamber and of the deflectors are straight.

In fact, as is clear from FIG. 5, the leading edge 46 of the flame 47 produced by this burner 2' has a rectilinear central part bordered by two lateral projecting horns 48, 49.

It is clear that the isotherms of the gas flow generated by flame 47 have a similar trend and that there exists therefore a risk of burning film 45 at the level of the lateral regions of the flow.

Furthermore, this risk of burning is considerably aggravated with a variation of orientation of burner 2' inducing a defect of parallelism between the central part of the leading edge of flame 47 and the zone of the film being treated (illustrated with broken lines in FIG. 5).

In this case, the film will overheat in the lateral region 50 of the gas flow.

The invention therefore overcomes these two drawbacks because it makes it possible to obtain a flame leading edge free of horns and because the circular shape of this leading edge overcomes the harmful effects of a variation of orientation of the burner head.

It should be noted that the burner of the invention may be associated with a gun shaped body 53 including a trigger 54 which controls both admission of the fuel gas and the ignition circuit of the burner.

Advantageously, this ignition circuit may include a piezoelectric generator actuated by trigger 54 and a spark plug 55 extending into the ignition chamber 11.

It has however proved that, because of the circular shape of the burner head 2 and the high outgoing speed of the gas flow, that the transmission of the flame over the whole extent of the outlet section of the burner does not always take place correctly at the time of ignition, particularly when the length of this outlet section is considerable.

The invention therefore overcomes this problem by placing, in the middle zone of the ignition chamber 11, an obstacle of small height applied intimately against grid 24, so as to create a local disturbance of the gas flows, itself generating low speed zones where combustion may take place and propagate without generating a combustion zone under the obstacle.

This obstacle may extend over the whole or part of the middle zone of the diffusion grid 24, or possibly be disposed obliquely with respect thereto.

Figure 7:
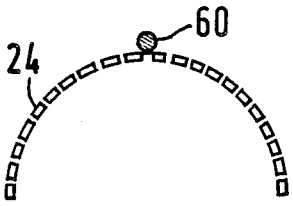
FIGS. 7 to 9 are diagrammatical sections of grids each having an obstacle whose purpose is to generate turbulences for transmitting the leading edge of the flame over the whole extent of the outlet section of the burner.
Figure 8:
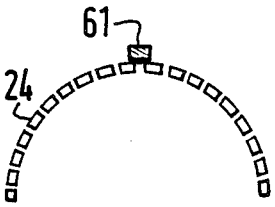
Figure 9:
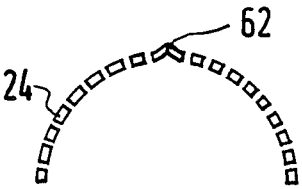

FIG. 7, 8 and 9 shows different possibilities of forming this obstacle.

Thus, FIGS. 7 and 8 show in cross section obstacles formed by a round wire 60 (FIG. 7) and by a square section wire 61 (FIG. 8) fixed to the diffusion grid 24.

In the example shown in FIG. 9, the obstacle is simply obtained by a bend 62 formed in the diffusion grid 24.

Of course, the invetion is not limited to the above described embodiments.

Thus, for example, the diffusion grid 24 could include a double wall at least over a part of its area.

Similarly, this grid 24 could be paired with a finer grid extending into the pressure recovery chamber or even in the ignition chamber so as to prevent possible backfiring.

What is claimed is:

1. A gas burner of the cold nozzle type including an injection device adapted for producing a high speed flow of fuel gas mixture and injecting this flow into a tubular shaped burner head comprising successively:

i- a pressure recovery chamber having, in the plane of symmetry of the head, a divergent shape and inside which the gas mixture coming from the injection device develops in a fan configuration, ii- an ignition chamber with two walls substantially parallel to said plane of symmetry, iii- two deflectors which extend respectively the two walls of the ignition chamber and which converge towards each other, these two deflectors having two rectilinear front edges forming therebetween a passage of reduced width, and iv- a diffusion grid a concave shape forming, inside the burner head, a convex dividing wall which separates the pressure recovery chamber from the ignition chamber, the concavity of this wall being oriented inwardly of the pressure recovery chamber, so that the lateral edges 24', 24" of this grid form with the two parallel walls flow paths for the gas flow in which combustion cannot take place, wherein the front edges of said walls to which the deflectors are connected, the front edges of these deflectors and the diffusion grid have circular shapes substantially coaxial to each other.

2. The burner as claimed in claim 1, wherein said diffusion grid is in the form of a toric sector with substantially semi-cylindrical section whose large radius of curvature corresponds substantially to that of said circular shapes.

3. The burner as claimed in claim 1, wherein said diffusion grid has a section including a curved part edged by two side wings.

4. The burner as claimed in claim 1, wherein said diffusion grid includes a double wall over at least a part of its area.

5. The burner as claimed in claim 1, further comprising, in the middle zone of the ignition chamber, an obstacle of small height applied intimately against the diffusion grid so as to create a local disturbance of the gas flows injected through the grid.

6. The burner as claimed in claim 5, wherein said obstacle consists of a wire fixed to the diffusion grid.

7. The burner as claimed in claim 5, wherein said obstacle is obtined by a bend formed in the diffusion grid.

8. The burner as claimed in claim 1, further comprising a fine grid extending against the diffusion grid.

* * * * *